US009822556B1

(12) United States Patent
Schroll

(10) Patent No.: US 9,822,556 B1
(45) Date of Patent: Nov. 21, 2017

(54) RETRACTABLE LATCH BOLT ASSEMBLIES FOR UPGRADING LOCKS

(71) Applicant: The Eastern Company, Wheeling, IL (US)

(72) Inventor: Matthew D Schroll, Glendale Heights, IL (US)

(73) Assignee: THE EASTERN COMPANY, Wheeling, IL (US)

( * ) Notice: Subject to any disclaimer, the term of this patent is extended or adjusted under 35 U.S.C. 154(b) by 20 days.

(21) Appl. No.: 14/999,867

(22) Filed: Jul. 13, 2016

(51) Int. Cl.

| | |
|---|---|
| ***E05B 65/44*** | (2006.01) |
| ***E05C 5/00*** | (2006.01) |
| ***E05B 55/00*** | (2006.01) |
| ***E05B 15/04*** | (2006.01) |
| ***E05B 65/06*** | (2006.01) |

(52) U.S. Cl.
CPC ..... *E05B 65/44* (2013.01); *E05B 15/04* (2013.01); *E05B 55/005* (2013.01); *E05B 65/06* (2013.01); *E05C 5/00* (2013.01); *E05Y 2900/20* (2013.01)

(58) Field of Classification Search
CPC ..... E05B 65/087; E05B 65/0876; E05B 65/0082; E05B 65/46; E05B 65/44; E05B 15/04; E05B 55/005; E05B 65/06; E05C 5/00; E05C 5/02; E05C 5/04; E05C 2005/005; E05Y 2900/20
USPC .... 70/77, 78, 81, 83, 85, 86, 106, 125, 127, 70/379 R, 379 A, 380; 292/63–65, 163, 292/164
See application file for complete search history.

(56) References Cited

U.S. PATENT DOCUMENTS

| | | | | |
|---|---|---|---|---|
| 1,160,105 | A | 11/1915 | Bodenstein | 292/27 |
| 1,268,503 | A | 6/1918 | Shaw | 70/81 |
| 1,384,022 | A | 7/1921 | Best | 70/340 |
| 1,937,942 | A | 12/1933 | Briggs | 70/29 |
| 2,093,038 | A | 9/1937 | Douglas | B60K 37/06 248/27.3 |
| 2,115,680 | A | 4/1938 | Dyson | 292/194 |
| 2,123,940 | A | 7/1938 | Gray | 70/364 |
| 2,198,952 | A * | 4/1940 | Sitko | E05B 17/0025 292/163 |
| 2,255,402 | A | 9/1941 | Vile | 70/139 |
| 2,503,315 | A * | 4/1950 | Baker | E05C 1/16 292/153 |
| 2,580,882 | A | 1/1952 | Blohm | 70/340 |
| 2,639,177 | A * | 5/1953 | Smith | E05B 65/0035 292/163 |
| 2,782,625 | A | 2/1957 | Williams | 70/455 |
| 2,804,765 | A | 9/1957 | Biblin | E05C 3/042 70/372 |
| 2,952,926 | A | 9/1958 | Chervenka | 70/79 |

(Continued)

*Primary Examiner* — Lloyd Gall
(74) *Attorney, Agent, or Firm* — David A. Burge

(57) ABSTRACT

Spring-projected latch bolt assemblies each having a retractable latch bolt component are used to upgrade commercially available lock operating mechanisms so that closures carrying the upgraded lock operating mechanisms can lock automatically when the closures reach their fully closed positions. To permit unobstructed closing of each closure, a normally extended component of each associated spring-projected latch bolt assembly retracts during a final segment of the closing of an associated closure, and snaps back to its fully extended position as the associated closure comes to rest in its fully closed position.

20 Claims, 7 Drawing Sheets

(56) References Cited

U.S. PATENT DOCUMENTS

| | | | | | |
|---|---|---|---|---|---|
| 3,190,092 | A | | 6/1965 | Patriquin | E05B 9/04 248/27.1 |
| 3,212,307 | A | | 10/1965 | Hallgren | 70/364 |
| 3,261,188 | A | | 7/1966 | Kerr | 70/363 |
| 3,336,774 | A | | 8/1967 | Gray et al. | 70/367 |
| 3,399,555 | A | | 9/1968 | Gray et al. | 70/369 |
| 3,402,958 | A | | 9/1968 | Barry | 292/62 |
| 3,418,833 | A | | 12/1968 | Kerr | 70/421 |
| 3,503,233 | A | | 3/1970 | Armstrong | E05B 9/084 70/370 |
| 3,581,534 | A | | 6/1971 | Testa | 70/383 |
| 3,789,638 | A | | 2/1974 | Roberts et al. | 70/366 |
| 4,626,007 | A | * | 12/1986 | Larson | E05B 19/0005 292/65 |
| 4,689,978 | A | | 9/1987 | Drummond | E05B 9/04 70/372 |
| D350,686 | S | | 9/1994 | Myers | D8/343 |
| D365,011 | S | | 12/1995 | Myers | D8/331 |
| 5,479,800 | A | | 1/1996 | Myers | E05B 15/1635 70/365 |
| D398,153 | S | | 9/1998 | Rubensson | D8/343 |
| D469,680 | S | | 2/2003 | Laabs | D8/343 |
| D474,102 | S | | 5/2003 | Laabs et al. | D8/346 |
| D477,984 | S | | 8/2003 | Laabs et al. | D8/343 |
| D482,596 | S | | 11/2003 | Laabs | D8/343 |
| D490,686 | S | | 6/2004 | Martin | D8/343 |
| 6,854,774 | B2 | | 2/2005 | Magnusson | 292/165 |
| 6,868,705 | B2 | | 3/2005 | Miao | E05B 17/04 70/222 |
| 7,021,679 | B2 | | 4/2006 | Magnusson | 292/66 |
| D551,941 | S | | 10/2007 | Miao et al. | D8/336 |
| D634,605 | S | | 3/2011 | Guimaraes | D15/28 |
| D795,674 | S | * | 8/2017 | Schroll | D8/343 |
| 2004/0183312 | A1 | | 9/2004 | Magnusson | 292/95 |
| 2005/0151378 | A1 | | 7/2005 | Magnusson | 292/165 |
| 2014/0319849 | A1 | | 10/2014 | Kamin et al. | 292/140 |

* cited by examiner

RETRACTABLE LATCH BOLT ASSEMBLIES FOR UPGRADING LOCKS

REFERENCE TO SUBJECT-MATTER-RELATED PATENT DOCUMENTS

The attention of the Patent Office is directed to Design application Ser. No. 29/620,127 filed concurrently herewith by the inventor hereof, being entitled SET OF COMPONENTS FOR UPGRADING A LOCK, the disclosure of which is incorporated herein by reference, in its entirety, and for all purposes.

Other patent documents including published applications and patents are identified later herein. Their disclosures are incorporated herein by reference, in their entireties, and for all purposes.

FIELD OF THE INVENTION

This invention relates to keyed and non-keyed locks that can relock automatically when closures on which the locks are mounted are moved to, or are returned to the fully closed positions of the closures after the closures have been opened.

More particularly, this invention relates to the closing of closures that carry lock operating mechanisms to which are connected spring-projected, retractable latch bolt assemblies (embodying features of the present invenLion) that each have a retractable component that retracts automatically during a final segment of the closing of the associated closure to permit the closure to close to its fully closed position without being blocked or otherwise prevented from completing its closing movement—with the closure being locked promptly and automatically when the closure reaches its fully closed position because the retracted component snaps back to its fully extended position while still residing in its locked orientation.

In yet another respect, the present invention relates to spring-projected latch bolt assemblies used to upgrade commercially available lock operating mechanisms so that closures carrying the lock operating mechanisms can lock automatically when these closures reach their fully closed positions. To permit unobstructed closing of a closure, a normally extended component of the associated spring-projected latch bolt assembly retracts while the moving closure passes through a final segment of the closure's closing movement, and snaps back to its fully extended position as the closure comes to rest in its fully closed position.

Although the present invention is not limited to being used on or with the operating mechanisms of so-called cam locks, retractable latch bolt assemblies (that embody a preferred practice of the invention) can directly replace many of the traditional elongate cams of cam locks to give closures that carry the upgraded cam lock operating mechanisms the desirable new capability of locking automatically when these closures reach their fully closed positions.

Closures that once carried conventional cam locks (but have had the elongate cams of the cam locks replaced by spring-projected retractable latch bolt assemblies that embody the preferred practice of the present invention) are sometimes referred to as being equipped with "slam capable, automatically relockable cam locks."

BACKGROUND

In many applications and environments, costly items such as medical equipment, and restricted items such as certain medical supplies, are contained in cabinet drawers and in compartments located behind the doors of medical cabinetry that is normally kept locked. Persons such as doctors and nurses who are authorized to access these items often find themselves opening and closing the locked doors and drawers of medical cabinets frequently during nearly every busy workday.

Many other applications need locks or latches that automatically relock or relatch in response to the closures that carry the locks and latches being returned to closed positions after being deliberately opened—including, for example, the doors and drawers of cabinetry installed on sea-going vessels that need to be held releasably closed even when these craft are subjected to rocking action caused by waves during inclement weather.

A type of relatively inexpensive keyed or nonkeyed lock that has gained wide acceptance during decades of use on cabinets and the like, has a tubular housing that is mountable in an opening formed through each cabinet closure that needs to be releasably retained. The type of keyed or non-keyed lock being referred to here has an operating mechanism that extends forwardly-rearwardly through the tubular housing. At or near the front of the tubular housing, components of the operating mechanism define a forwardly-opening keyway into which an operating key can be inserted. At or near the rear of the tubular housing, the operating mechanism defines a rearwardly extending formation that drivingly engages a transversely extending cam. When a correctly-configured operating key is inserted into the keyway at the front of the lock, and is turned, the elongate cam that is connected to the formation of the operating mechanism at the rear of the lock is turned a corresponding amount such that the turning of the inserted operating key causes the operating mechanism to turn about a forwardly-rearwardly extending axis of the tubular housing of the lock. Keyed versions of such products are commonly called "cam locks." Non-keyed versions of such products (that may have thumb-turned operating mechanisms) are sometimes called "cam latches," or are included (as they are in this document) in what are called "cam locks."

When the elongate cam of a conventional cam lock on a cabinet closure (such as a cabinet door or a cabinet drawer front) is in, or is turned to, its locked orientation WHILE THE CLOSURE IS CLOSED, a distal end region of the elongate cam extends behind or reaches behind a nearby stationary component of the associated relatively stationary cabinet structure to thereby prevent forward movement of the closure away from where the closure is being retained in its locked position—which is because the elongate cam cannot move forwardly when it is extending behind or reaching behind the associated cabinet component of what is typically a stationary cabinet.

When the elongate cam of a conventional cam lock on a cabinet closure (such as a cabinet door or a cabinet drawer front) is in, or is turned to, its unlocked orientation WHILE THE CLOSURE IS CLOSED, the distal end region of the elongate cam does not extend behind or reach behind any nearby stationary component of the associated stationary cabinet—which means the associated cabinet closure is unlocked and can be moved between the closed position and the open position (and back again) because the cam does not limit the opening and closing movement of the closure.

When the elongate cam of a conventional cam lock mounted on a cabinet closure (such as a cabinet door or a cabinet drawer front) is in, or is turned to, its locked orientation WHILE THE CLOSURE IS OPEN, the distal end region of the elongate cam does not extend behind or reach behind any nearby stationary component of the associated stationary cabinet—which means that, although it may be possible to push the closure at least some of the distance toward its fully closed position, IT IS NOT POSSIBLE TO PUSH THE CLOSURE ALL OF THE DISTANCE TOWARD ITS FULLY CLOSED POSITION because, although the distal end region of the elongate cam does not extend or reach behind any nearby stationary component of the stationary cabinet, the distal end region of the elongate cam nonetheless does extend away from where it is carried LIKE A RED FLAG FORECASTING BAD WEATHER—and, if the closure is pushed vigorously toward its fully closed position, the distal end region of the elongate cam will come quickly into contact with a front face of the same stationary cabinet component that the distal end region reached behind or extended behind when the closure was being locked in its closed position.

A sudden and abrupt halt that can unexpectedly occur while the closure is being vigorously (and perhaps forcefully) pushed to or toward the closure's closed position is sometimes accompanied by a rather loud and startling "WHAM" or even an embarrassing and attentiondrawing "THUD" as the distal end region of the elongate cam impacts the same stationary cabinet component that the elongate cam reached behind when the closure was locked in its fully closed position (or when the distal end region of the elongate cam strikes some other stationary cabinet component located in front of said stationary component). What is described just above is sometimes called the "IMPACT PROBLEM ASSOCIATED WITH CONVENTIONAL CAM LOCKS." It is depicted in FIG. 3, and will be discussed shortly.

If and when the distal end region of the elongate cam strikes a stationary front surface of the cabinet closure, this can damage the front surface of the cabinet component that is impacted by the distal end region of the elongate cam. If the so-called IMPACT PROBLEM occurs repeatedly or often, the damage caused to the front surface of the stationary cabinet component that is struck by the extended distal end region of the elongate cam can become extensive and unsightly.

If the IMPACT PROBLEM has occurred as the result of a disgusted user of the cabinet being aggravated by the failure of the closure to properly close, damage caused by the IMPACT PROBLEM may escalate—perhaps resulting in the closure being again slammed, perhaps even more forcefully in an effort to shut the obstinate closure—and, this time, the resulting damage may be even more extensive—perhaps even causing damage to the extended elongate cam itself, or even causing the elongate cam to become detached, dislodged or disconnected from a rearwardly extending formation of the lock operating mechanism (that needs to have a secure connection to the elongate cam to pivot the elongate cam between its locked and unlocked orientations.

It frankly does not matter WHY the elongate cam carried by a closure-mounted a cam lock has gotten itself turned to its locked orientation while the associated closure has been in its open position. (Actually, there are some good reasons why the cam of a cam lock carried by a closure may have gotten itself pivoted to a locked orientation while the closure is in its open or opened position—an example being that some cam locks only permit key removal when the lock has been turned to its locked orientation—and, because people sometimes do not want to leave keys where they might be pulled from the keyways of locks, they turn the cam locks to their locked orientations, so they can remove a key and take it with them while the closure remains in an opened position.)

Some efforts have been made by others during relatively recent years to upgrade the operating mechanisms of conventional cam locks (and cam-like locks) that are (or are intended to be) mounted on closures, to give such closures "slam capability." Some of these efforts have sought to replace the elongate cams traditionally carried by cam locks with assemblies of components that permit closures (that carry the enhanced cam lock operating mechanisms) to move to their fully closed positions without any need to first pivot the cam of an enhanced c am lock operating mechanism to its unlocked orientation.

Southco, Inc. did some work along these lines that dates back at least as far as the Fall of the year 2004, as is shown by Southco's applications 2004/0183312 published on Sep. 23, 2004, and 2005/0151378 published on Apr. 4, 2006, that eventually became Southco's U.S. Pat. No. 6,854,774 issued Feb. 15, 2005, and U.S. Pat. No. 7,021,679 issued Apr. 4, 2006, respectively.

A mechanically similar retractable latch bolt assembly appears to be disclosed in a Design Patent that is assigned on its face to Fort Lock Corporation, namely Patent D-365,011 issued Dec. 12, 1995; and, is more clearly disclosed in a published application of CompX International Inc. 2014/0319849 dated Oct. 30, 2014.

Although the mechanism proposals contained in the several the documents referenced above can be used to provide closures with a slam capability, each of these proposals calls for the use of a relatively large housing to be mounted at the rear of the operating mechanism of a cam lock (or a cam-like lock), with the relatively large housing surrounding a relatively small retractable latch bolt component that is biased outwardly with respect to its associated housing through an opening defined by the housing. The small latch bolts are not closely confined by pairs of surfaces defined by components that reach into hollow regions of the small latch bolts to confine latch bolt movement to specific travel paths. Each of the bulky housings contain little more than a compression coil spring that biases the small associated latch bolt outwardly with respect to the interior of the housing.

The slam-capability proposals contained in the published applications and patents identified above are mechanically similar in that the assemblies suggested by these proposals do include any components that extend into hollow interiors of, or through openings defined by sidewalls of the relatively small latch bolts that are biased outwardly through the relatively small openings defined by the relatively large housings that are called for by the proposals found in the documents identified above.

SUMMARY OF THE INVENTION

In preferred practice, the present invention takes an advantageously different approach to the challenge of providing a reliable, retractable, spring-projected latch bolt assembly that is mountable at or near the rear of the operating mechanisms of many conventional cam locks, as well as other types of lock cylinder assemblies.

Although the present invention is not limited to being used exclusively with the operating mechanisms of so-called "cam locks," spring-projected retractable latch bolt assemblies that embody features of the preferred practice of the present invention can directly and advantageously replace many of the elongate cams that are in use on the operating mechanisms of conventional cam locks to provide closures on which the upgraded cam lock operating mechanisms are mounted with a reliable slam capability not previously offered by conventional cam locks mounted on the closures.

The present invention provides spring-projected retractable latch bolt assemblies each being formed from a small set of components that, in assembled form, provide two relatively movable sub-assemblies that are biased away from each other, with a first of the sub-assemblies forming a lengthy, hollow, retractable and extensible latch bolt that is confined by features of the second sub-assembly to move along a precise linear travel path as the latch bolt slidably retracts toward or extends away from the second sub-assembly, with the second sub-assembly also being operable to pivot the linear travel path to either a selected locked (or lockable) orientation, or to a selected unlocked orientation.

In preferred practice, sets of precisely formed components that each include a lengthy, retractable and extensible latch bolt component (as well as other components that extend into a hollow interior of the retractable latch bolt component) define a plurality of pairs of engaging surfaces that cooperate to confine the retraction and extension movements of the lengthy latch bolt component to a precise linear travel path.

In preferred practice, spring-projected latch bolt assemblies are formed by an assemblable set of components that each includes a relatively lengthy, relatively narrow, retractable latch bolt component that defines a pair of spaced, substantially parallel-extending sidewalls that are integrally connected by a transversely-extending top wall having an elongate slot formed therethrough that parallels the length of the two sidewalls, with the elongate slot communicating with an open interior of the retractable latch bolt component, through which slot (and into the open interior of the lengthy latch bolt component) others of the components extend that cooperate to connect the retractable latch bolt assembly to an operating mechanism of a conventional lock cylinder assembly that is capable of turning the retractable latch bolt assembly between locked and unlocked orientations.

Two significant advantages of spring-projected latch bolt assemblies that embody the preferred practice of the present invention are 1) that the retractable latch bolt assemblies can directly replace many the elongate cams of conventional "cam locks" to upgrade the cam lock operating mechanisms, and 2) that closures on which the upgraded operating mechanisms are installed can be moved, or even slammed, to their fully closed positions without needing to first pivot the retractable latch bolt assemblies to their unlocked orientations before fully closing the closures.

What this can mean is that a key-operated cam lock operating mechanism that has been upgraded (by replacing its conventional elongate cam with a spring-projected retractable latch bolt assembly) and is mounted on a closure that has been moved to an open position does not need to have its operating key reinserted into the keyway of the operating mechanism and turned from a locked orientation to an unlocked orientation before the opened closure can be moved to its fully closed position where the closure automatically locks because the retractable latch bolt assembly is still in its locked orientation where it is ready to lock the closure just as soon as the closure reaches its fully closed position.

Therefore, cabinet closures such as the doors and drawers of medical cabinetry and the like that are normally kept locked (because these cabinets contain restricted medical supplies and costly medical equipment that has often been sterilized and wrapped for use in surgery by doctors and nurses) can be closed and automatically locked by employees who have no need to access keys that are capable of opening such cabinetry.

DESCRIPTION OF THE DRAWINGS

These and other features, and a fuller understanding of the invention may be had by referring to the following description and claims, taken in conjunction with the accompanying drawings, wherein:

FIGS. 1-6 all show portions of the PRIOR ART cam lock installed on the same substantially flat, door-type, pivotally mounted on the closure which can be pivoted between closed and open positions to selectively close and open such a typical cabinet opening of a typical, substantially stationary, PRIOR ART cabinet structure. More specifically:

FIG. 1 is a top plan view showing both leftwardly-extending and rightwardly-extending portions of a typical PRIOR ART stationary cabinet structure on which is pivotally mounted a door-type closure (that is shown in a foreshortened depiction) that has a conventional PRIOR ART cam lock mounted thereon, with the cam lock carrying an elongate, rear-mounted cam that can be turned (by operating the cam lock) between locked and unlocked orientations—it being noted that FIG. 1 shows the door-type closure in its fully closed position, with the elongate cam of the PRIOR ART cam lock turned to its locked orientation wherein a distal left end region of the elongate cam is caused to extend behind (i.e., to reach behind and to engage) a stationary component of the cabinet structure to prevent the closure from being opened (i.e., to keep the door-type closure from being moved out of the depicted fully closed and locked position toward any of many open and unlocked positions of the door-type closure);

FIG. 2 is a rear elevational view of selected portions of the PRIOR ART components shown in FIG. 1 (with all of the depicted component portions being positioned as shown in FIG. 1);

FIG. 3 is a top plan view that is provided to illustrate the "impact problem" that occurs if and when someone tries to move (which attempted movement sometimes takes place relatively vigorously) a closure equipped with a conventional PRIOR ART cam lock to the closure's fully closed position—it being understood that closures which are equipped with conventional PRIOR ART cam locks can be successfully fully closed ONLY IF AND WHEN the elongate cams of the PRIOR ART cam locks carried by the closures have been pivoted to their unlocked orientations—with FIG. 3 illustrating a moment of impact when the elongate cam of a PRIOR ART cam lock strikes the same stationary member that the elongate cam reaches behind (as is shown in FIG. 1) when the cam is turned to its locked orientation after the closure has been fully closed—it being understood that the "impact problem" illustrated in FIG. 3 arises because closures that are equipped with conventional PRIOR ART cam locks can only be moved to their fully closed positions if and when the elongate rear-mounted cams of PRIOR ART cam locks have been turned to their unlocked orientations;

FIG. 4 is a rear elevational view of selected portions of the PRIOR ART components as shown in FIG. 3 (with all of the depicted component portions being positioned as shown in FIG. 3);

FIG. 5 is a top plan view similar to FIG. 1 except that the elongate cam of the PRIOR ART cam lock is pivoted to its unlocked orientation where the distal end region of the elongate cam is moved away from the stationary component of the cabinet structure to permit free movement of the door-type closure to and from the depicted fully closed position of the door-type closure—hence the closure shown in FIG. 5 is unlocked;

FIG. 6 is a rear elevational view of selected portions of the PRIOR ART components as shown in FIG. 5 (with all of the depicted component portions being positioned as shown in FIG. 5);

FIG. 7 is another PRIOR ART view (namely a rear elevational view as seen from a plane indicated by a line 7-7 in FIG. 1) showing a thin, basically washer-like, stop-defining member that has a square, centrally located opening that closely receives (and thereby drivingly connects with a rearwardly-extending square formation the a key-controlled operating mechanism that is a part of the PRIOR ART cam locks that are shown in FIGS. 1, 3 and 5 (with substantially the same type of key-controlled operating mechanism being shown in FIG. 15 where an operating key is shown extending into the forwardly-opening keyway of the operating mechanism), with FIG. 7 also showing a thin, washer-like, stop-defining member that cooperates with a housing-defined stop formation, with stops defined by the washer-like stop-defining member to limit the relative movement of the tubular housing and the keyway-controlled operating mechanism that is drivingly connected to the elongate cam shown in FIGS. 1-6;

FIG. 8 is a top plan view similar to FIG. 1 but with the PRIOR ART cam that is shown in FIG. 1 being directly replaced by a retractable latch bolt assembly embodying features of the present invention, with components of the retractable latch bolt assembly being shown in a normal fully extended position, with the retractable latch bolt assembly pivoted to the locked orientation, wherein an inclined distal left end region of a latch bolt component of the retractable latch bolt assembly can be seen to reach behind and to engage the short, rearwardly extending leg of the L-shaped leftwardly-extending cabinet portion;

FIG. 9 is a rear elevational view of selected portions of the components shown in FIG. 8 (with all of the depicted component portions being positioned as shown in FIG. 8);

FIG. 10 is a top plan view that is similar to FIG. 8, except that the door-type closure is shown during a brief time-segment of the process of closing the door-type closure when a tip of the inclined, distal left end region of the retractable (but spring-projected) latch bolt component is moving and wiping along a surface defined by the short leg of the L-shaped portion of the cabinet structure that defines a left-most region of the cabinet opening that will very soon be closed by the closure when the closure reaches its fully closed position, whereupon the closure will automatically lock itself in its fully closed position, as is depicted by FIGS. 8 and 9;

FIG. 11 is a rear elevational view of selected portions of the components as shown in FIG. 10 (with all of the depicted component portions being positioned as shown in FIG. 10)—it being noted that this view shows almost better than any other view of the drawing just how the retractable latch bolt component can retract by permitting relative movement of the two sub-assemblies formed by the components of the retractable latch bolt assembly;

FIG. 12 is a top plan view that is quite similar to FIG. 10, except this view depicts an earlier time during the process of closing the door-type closure when the retractable latch bolt component has just begun engaging a right angle portion of the L-shaped cabinet component as the door-type closure is moving toward its fully closed position, it being seen that the retractable latch bolt component of the retractable latch bolt assembly is just beginning to retract as the right-angle bend of the L-shaped cabinet component is working its way down the inclined surface in opposition to the springs that press the retractable latch bolt component leftwardly as viewed in FIGS. 8 and 9;

FIG. 13 is a rear elevational view of selected portions of the components as shown in FIG. 12 (with all of the depicted component portions being positioned as is shown in FIG. 12);

FIG. 14 is a rear elevational view showing the retractable latch bolt assembly in its fully extended position but turned to its unlocked orientation (in a manner that corresponds to how FIG. 6 shows the flat PRIOR ART cam of the conventional PRIOR ART cam lock turned to its unlocked orientation).

DETAILED DESCRIPTION

As has been explained, one aspect of the present invention resides in providing a method of, and a means for, upgrading the lock operating mechanisms of several types of locks—to give closures (on which the upgraded lock operating mechanisms are mounted) a new capability to lock automatically in response to the arrival of these closures in their fully closed positions.

As also has been explained, another feature of the present invention resides in the provision of spring-projected, retractable latch bolt assemblies for directly replacing the traditional rear-mounted elongate cams of cam locks—so that closures (which carry and rely on the enhanced cam lock operating mechanisms) are given the new ability to lock promptly when these closures reach their fully closed positions.

Yet another previously mentioned feature of the present invention resides in the provision of spring-projected, retractable latch bolt assemblies formed from kits of component parts that (when assembled and connected to lock operating mechanisms of cam locks, and the like, that are mounted on closures which) each have a latch bolt component that retracts during a final segment of closing movements of the closures, and that then snap back to extended positions to lock the closures closed upon assuming fully closed positions.

Overview of the Drawings

Figures 1, 2, 3, 4, 5, 6, 7:
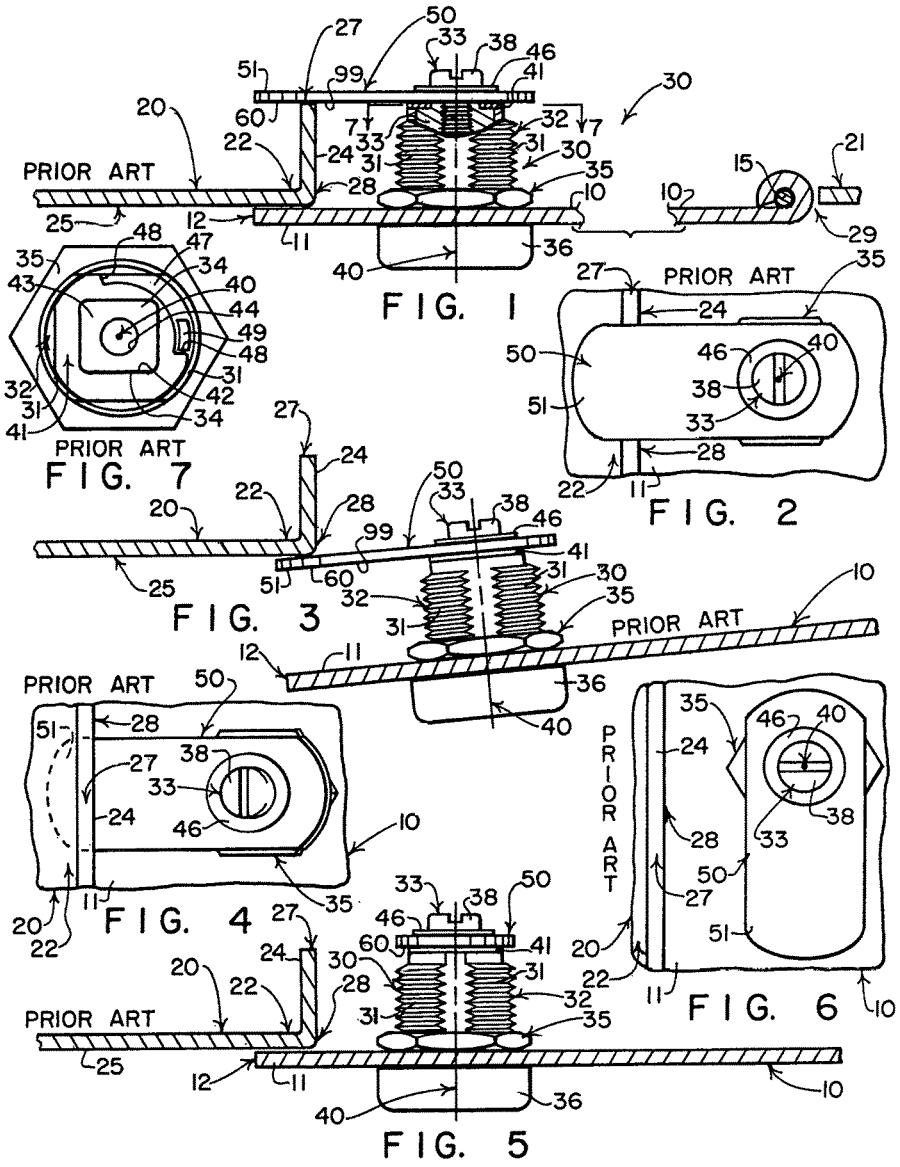
PRIOR ART FIG. 1
FIGS. 1-7 all show PRIOR ART features of a conventional PRIOR ART cam lock.

In overview, the entire first sheet of the accompanying drawings presents seven views (namely FIGS. 1-7) that show the construction, features and certain performance characteristics of a typical PRIOR ART cam lock mounted on a substantially flat, pivotally mounted door-type closure. As will be explained, the PRIOR ART cam lock has a conventional tubular housing that extends along a forwardly-rearwardly extending central axis so an operating mechanism that is journaled by the housing to turn about the central axis can pivot an elongate, rear-mounted cam between a locked orientation of the elongate cam (as shown in FIGS. 1 and 2), and an unlocked orientation (as shown in FIGS. 5 and 6).

The second and third sheets of the accompanying drawings presents seven additional views (namely FIGS. 8-14) that show the construction, features and certain performance characteristics of the same cam lock operating mechanism (as shown in FIGS. 1-7), but having a spring-projected, retractable latch bolt assembly (that embodies features of the present invention) directly replacing the traditional elongate cam of the cam lock.

Figure 14:
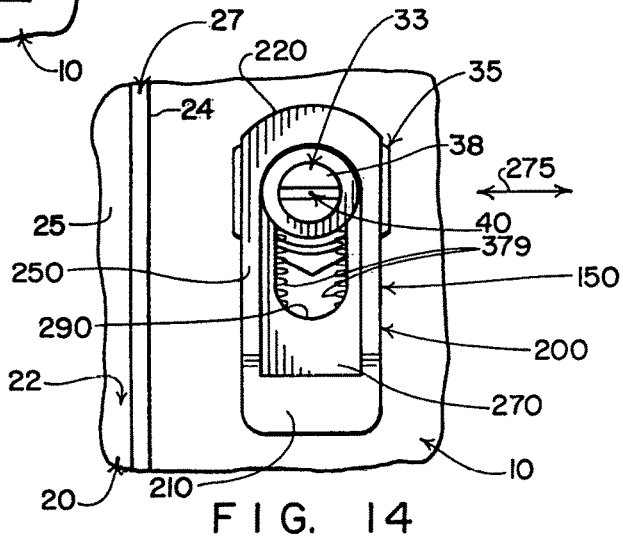
Figure 15:
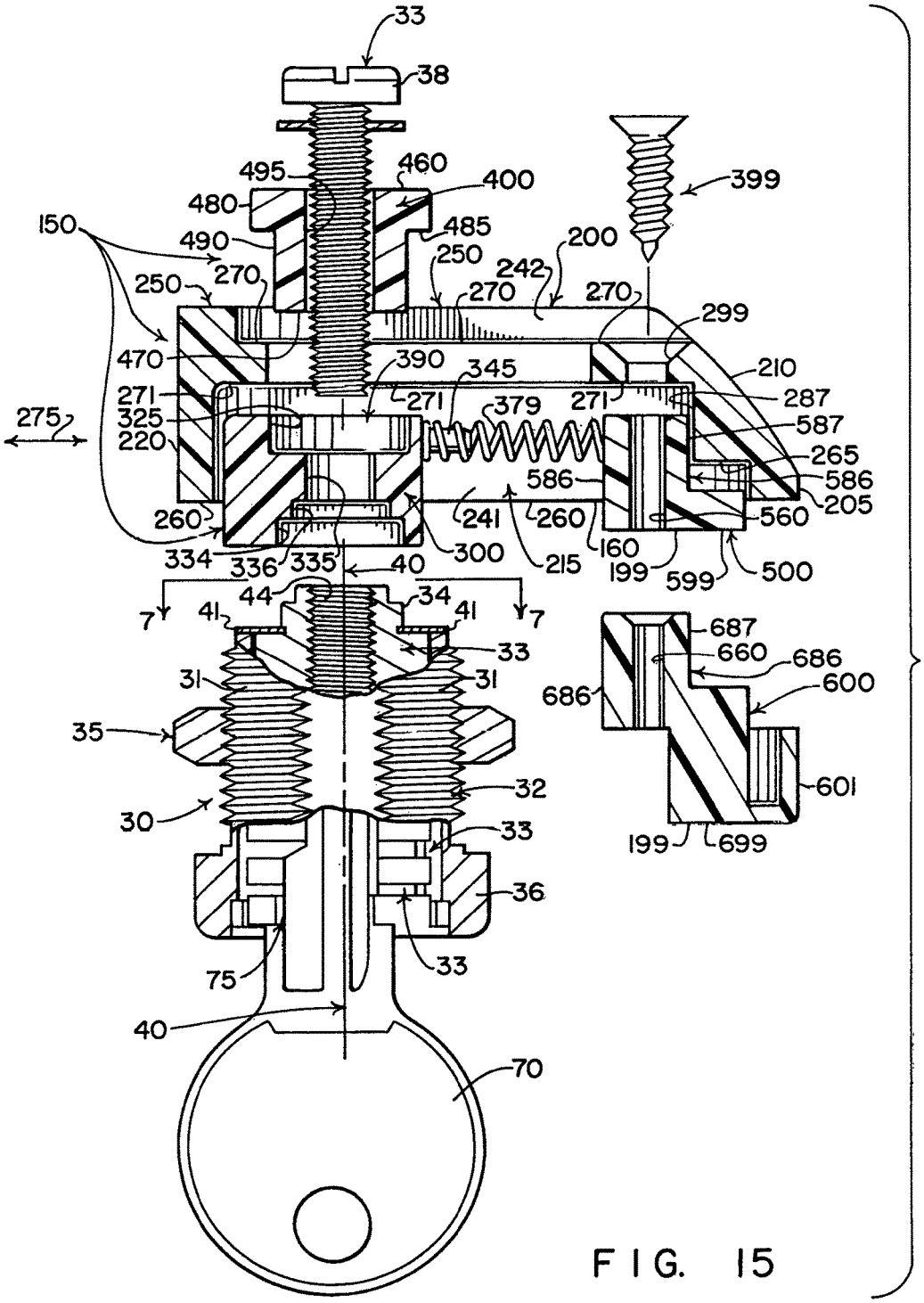
FIG. 15 is a partially exploded top plan view showing on a slightly larger scale the same conventional cam lock operating mechanism that is shown in FIGS. 1, 3, 5, 8, 10 and 12, with a key inserted into the keyway of the cam lock's operating mechanism, with the view showing in cross-section such components of the retractable latch bolt assembly as are formed from plastic material, but showing not in cross-section such components as are formed from metal (such as threaded fasteners and compression coil springs) being slightly vertically moved in relation to how these components are positioned when the spring-projected latch bolt assembly is fully assembled (as is shown in FIG. 16)

The fourth sheet of the accompanying drawings presents FIG. 15 that, on an enlarged scale, shows in cross-section five partially disassembled components of the spring-projected retractable latch bolt assembly that are illustrated in FIGS. 8-14. Also in a lower left quadrant of FIG. 15, substantially the same tubular housing and cam lock operating mechanism is shown (as is depicted in FIGS. 1, 3 and 5), but with front and rear portions of the tubular housing broken away so that certain features of the operating mechanism journaled inside the tubular housing can be seen.

Figure 16:
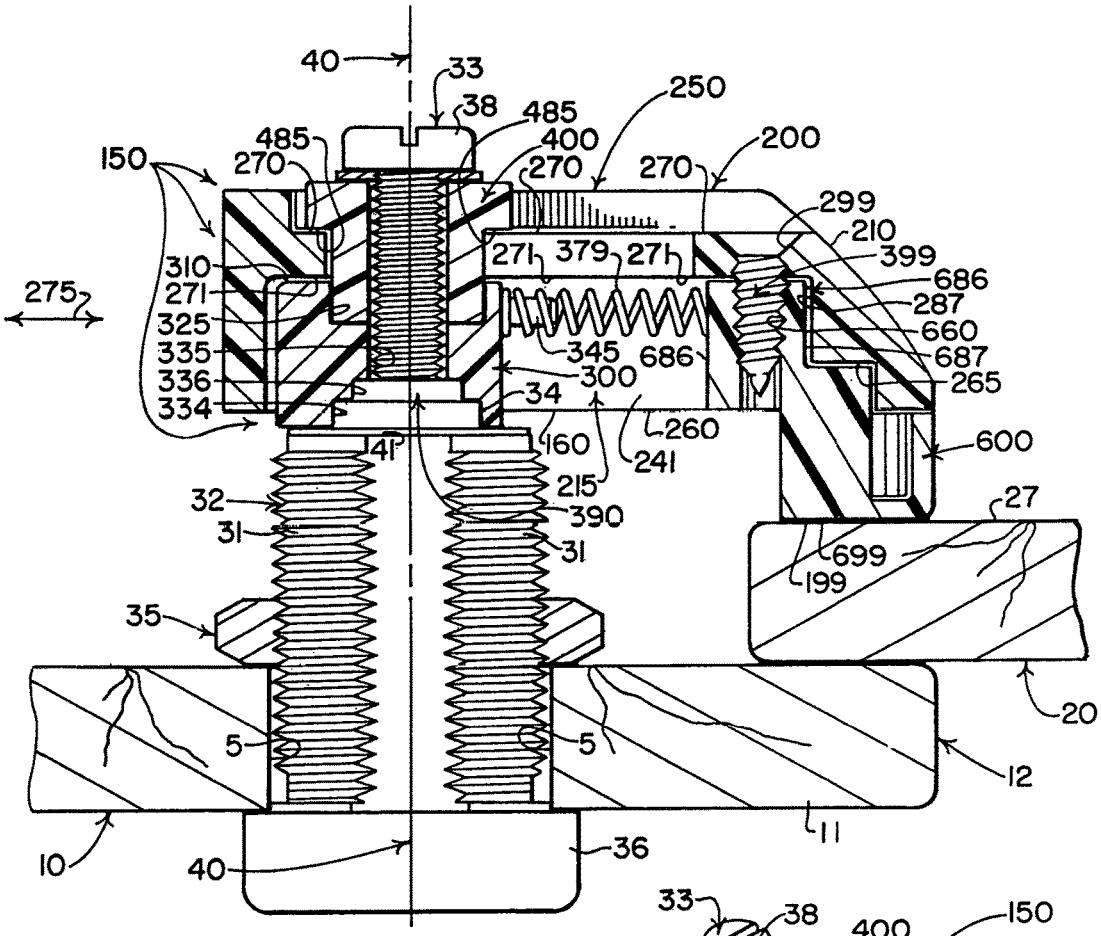
FIG. 16 is an assembled view showing how selected components chosen from among the components that are shown in FIG. 15 can fit together to provide a spring-projected retractable latch bolt assembly that makes use of an alternate spring-positioning member held in place by a flat-headed screw that has threads well suited to cut into plastic as the screw is tightened, and with the longer threaded machine screw positioned to extend along the center axis of the tubular housing of the operating mechanism when the screw is tightened into a rearwardly-extending component of the operating mechanism.

The fifth sheet of the accompanying drawings presents FIG. 16 which shows (in an assembled manner) four of the five retractable latch bolt assembly components that are shown in cross-section in FIG. 15. The fifth sheet also presents FIG. 17 that, on a reduced scale, shows sub-assemblies of selected components that are shown in FIG. 16.

Figure 18:
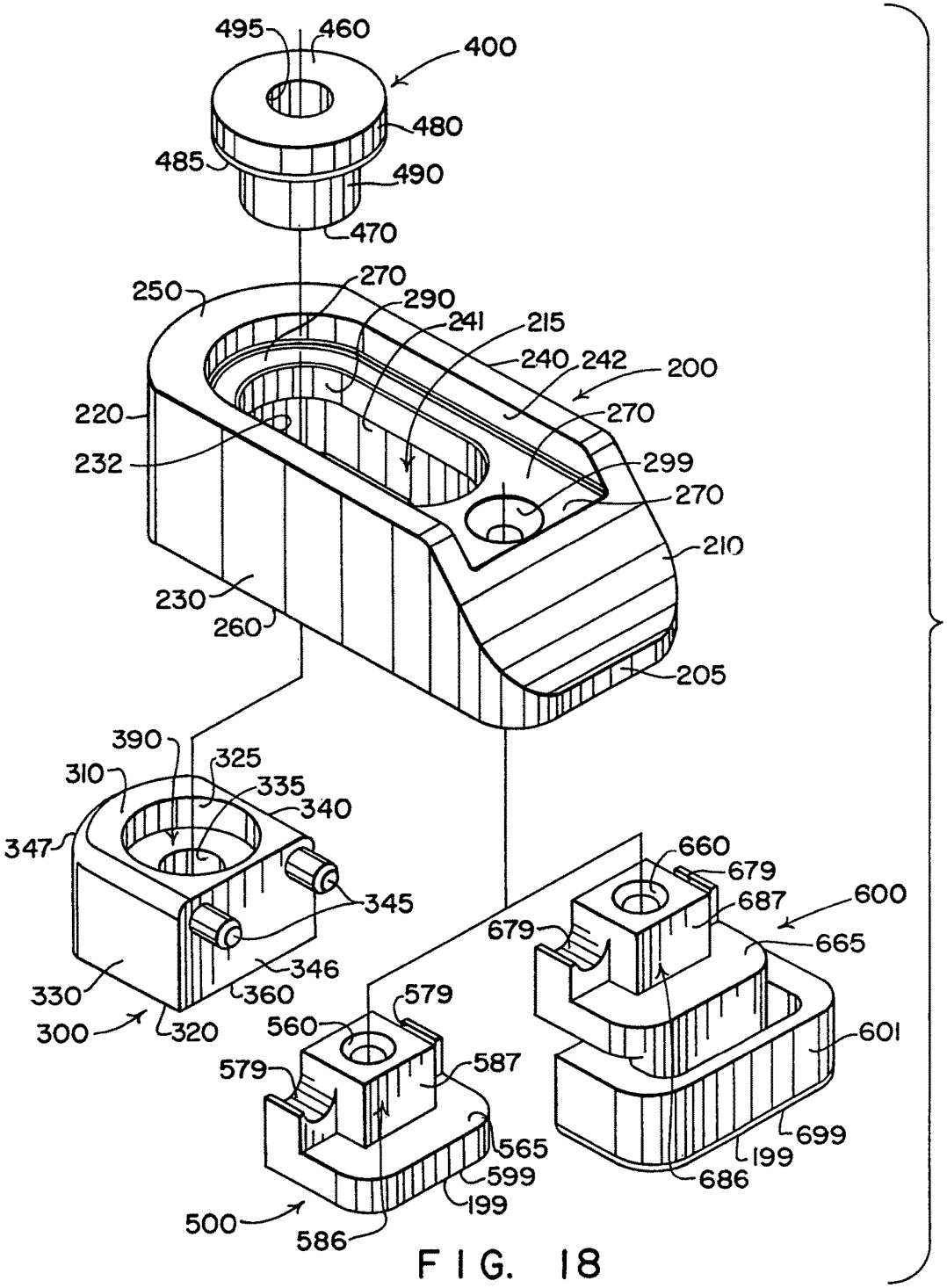
FIG. 18 is a perspective view of five of the components that can be formed either from plastics material, or from metal—with the components being assemblable to form two relatively movable sub-assemblies of a spring-projected, retractable, latch bolt assembly that embodies a preferred practice of the present invention; and, FIG. 19 is a perspective view of four components that can be formed either from plastics material, or from metal—with the components being assemblable to form two relatively movable sub-assemblies of a spring-projected, retractable, latch bolt assembly like the assembly that can be formed from the components shown in FIG. 18, but including a short spring-positioning component instead of the longer spring-positioning component that is shown in FIG. 18.
Figure 19:
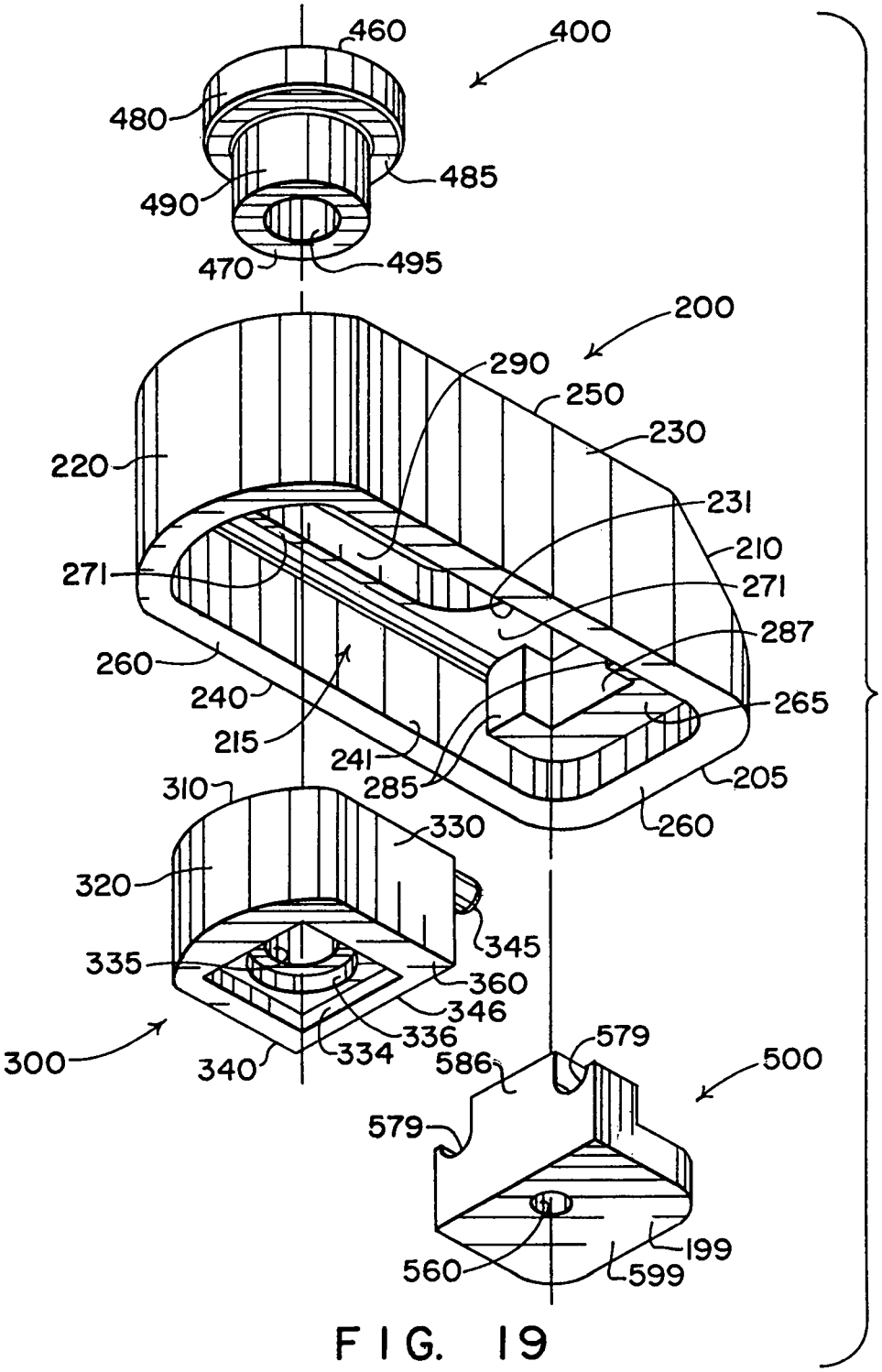

Lastly, a sixth and a seventh sheet of the accompanying drawings present FIGS. 18 and 19, respectively, that show in perspective five of the manufactured components, and then only four of the manufactured components that can be assembled to provide spring-projected retractable latch bolt assemblies, respectively, that can be formed from the components that are shown in cross-section in FIG. 15.

The Prior Art Depictions of FIGS. 1-7

Figure 17:
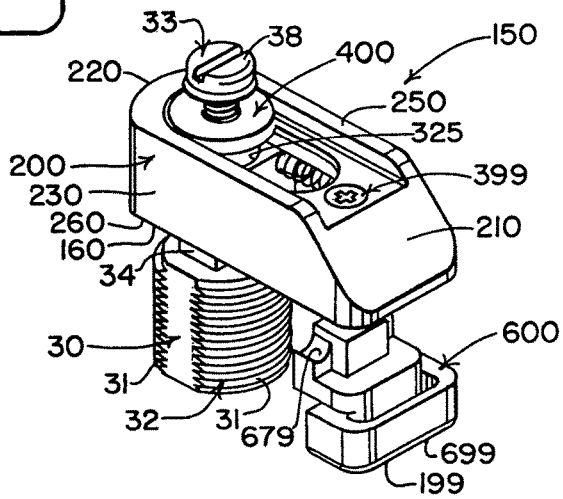
FIG. 17 is a perspective view on a diminished scale showing in partial assembly the components that are shown in FIG. 16, with a machine screw that will clamp some of the components of the retractable latch bolt assembly into driving engagement with the operating mechanism of a cam lock not being tightened into position.

The typical PRIOR ART cam lock 30 shown in FIG. 1 has a typical PRIOR ART tubular housing 32 that can be of various lengths depending on where and how the cam lock 30 is to be installed. In FIG. 16, a cam lock 30 having a tubular housing 32 is shown that is longer than the tubular housings shown in FIGS. 1, 3, 5, 8, 10, 12 and 15. In FIG. 17, only a rear portion of a tubular housing 32 is shown—suggesting that FIG. 17 can use a tubular housing 32 of substantially any length.

All of the various tubular housings 32 that are shown in various views of the accompanying drawings have threaded exterior surface portions 31 that permit a hex nut 35 to be tightened along the exteriors of the tubular housings 32 to engage rear surfaces of the door-type closures 10 that carry the tubular housings 32. When the depicted hex nuts 35 are tightened against rear surfaces of the depicted door-type closures 10, this draws bezels (that have diameters slightly larger than the tubular housings 32) against a front surface of the door-type closures 10.

In FIGS. 1, 3, 5, 8, 10 and 12 the door-type closure 10 is cross-sectioned to indicate that the door-type closure 10 is formed from metal. In FIG. 16, a door-type closure 10 made of wood is shown—which is the mechanical equivalent of the metal doors 10 that are shown in other views of the drawings. In FIG. 16, a typical hole, passage or opening 5 is shown that extends through the door 10 in an arrangement that can accommodate a tubular housing 32 that is longer than the tubular housing 32 shown in FIG. 16.

Referring once again to FIG. 1, the substantially flat door-type closure 10 is pivotally mounted to move between open and closed positions about a hinge pin 15. Leftwardly extending, and rightwardly extending portions of the same cabinet structure are indicated by the numerals 20 and 21, respectively. The leftwardly extending cabinet portion 20 is of an L-shape, as defined by a short leg 24 and a long leg 25 that are connected by a right angle bend 22. An edge or end surface 27 is defined by the short leg 24. The rightwardly extending cabinet portion 21 will be understood to support the hinge pin 15.

Left and right boundaries 28, 29 defined by the leftwardly extending and rightwardly extending cabinet portions 20 and 21, respectively, indicate the left and right portions of a cabinet opening that can be selectively closed and opened by pivoting the door-type closure 10 between the closed position shown in FIG. 1, and any of many open positions, it being understood that the door-type closure position shown in FIG. 3 is a "slightly open" position that illustrates a long-standing so-called IMPACT PROBLEM that is associated with many cam lock installations.

When the door-type closure 10 is fully closed (i.e., is in the closed position shown in FIG. 1), the elongate cam 50 has a distal end region 51 that engages and extends across the end surface 27 of the short leg 24 of the L-shaped cabinet formation 20. When the elongate cam 50 is pivoted to the locked orientation shown in FIGS. 1 and 2, the door-type closure 10 will be understood to be locked in its closed position—where an edge region 11 of the door-type closure 10 (which is relatively near to an edge or end surface 12 of the door-type closure 10) overlaps or overlies a portion of the long leg 25 of the L-shaped cabinet portion 20.

When the door-type closure 10 is open (or opened), the edge region 11 is pivoted away from the L-shaped cabinet portion 20. If the door-type closure 10 is opened much farther than is shown in FIG. 3, and then is pushed (or moved) toward the fully closed position shown in FIGS. 1 and 2, the distal end region 51 of the elongate cam 50 is quite likely to engage, strike or slam against the right-angle corner region 22 of the L-shaped cabinet portion 20.

Depending on how vigorously the door-type closure 10 is moved toward the fully closed position of the door-type closure 10, the distal end region 51 of the elongate cam 50 may simply come into contact with the right angle corner region 22, or may strike or impact the corner region 22 quite forcefully. Especially if the cabinet portion 20 is made of wood (as is shown in FIG. 16), the cabinet component 20 may be disfigured or damaged in an unsightly manner—or, the elongate cam 50 may be damaged, bent, loosened or disconnected from a rearwardly extending component of the operating mechanism 33 of the cam lock 30, hence, the so-called IMPACT PROBLEM that is illustrated in FIGS. 3 and 4 is to be avoided, if this is possible.

Referring to FIG. 7, a thin, washer-like, stop-defining member 41 of the cam lock 30 has about one-fourth of its circumference defined by a region of reduced radius 47 that extends in an arc between two radially extending stop formations 48. The remaining approximately three quarters of the circumference has a radius that very nearly equals the diameter of an rear end region of the tubular housing 32.

A projection 49 that is integrally formed with other portions of the tubular housing 32 extends into close proximity with the reduced radius portion 47 of the circumference of the stop-defining member 41 so that, when the operating mechanism 33 (and the washer-like stop-defining member 41 that turn about the central axis 40 concurrently with the elongate cam 50 and the headed, threaded fastener 38) pivot about the central axis 40 relative to the tubular housing 32 (and the projection 49), the stop-defining member 41 and the projection 49 cooperate to limit the range of relative angular movement of the cam 50 relative to the tubular housing 32 to approximately a quarter turn about the central axis 40.

Due to the stops 48 of the stop-defining member 41 that cooperate with the projection 49 of the tubular housing 32, the cam 50 has a limited range of angular movement about the central axis 40 when a correctly-configured operating key (such as the key 70 shown in FIG. 15) is inserted into the forwardly opening keyway (such as is indicated by the numeral 75 in FIG. 15), Thus, only a relatively short angular movement about the central axis 40 is needed to pivot the cam 50 between its locked orientation (as depicted in FIGS. 1 and 2, and its unlocked orientation (as depicted in FIGS. 5 and 6).

Direct Replacement of the Elongate Cam 50

When the components of the PRIOR ART cam lock 30 are positioned as shown in FIGS. 1, 3 and 5, the cam 50 can be seen to have what will be referred to as an "engagement surface 99" that does the work of the cam 50. If a flat closure panel 10 extends horizontally (as it might be said to be shown in FIGS. 1, 3 and 5), the engagement surface 99 faces downwardly. Actually, when the cam lock 30 is mounted on or carried by a typical vertically-extending closure (instead of being mounted on or carried by carried by the closure 10 that might be said to extend horizontally), the engagement surface faces forwardly—which means facing back toward the plane of the closure panel 10 as the closure 19 is shown extending substantially horizontally in FIGS. 1, 3 and 5.

Later in this document, bottom surfaces 599 and 699 of spring positioning components 500, 600 are mentioned. When the components 500 or 600 are extended into the latch bolt component 200 as shown in FIGS. 15 and 16, respectively, the bottom surfaces 599 and 699, respectively, perform the function of the engagement surface 199 as shown in FIGS. 8, 10 and 12—hence, the bottom surfaces of the components 500 and 600 both carry the engagement surface designation 199.

Figure 8:
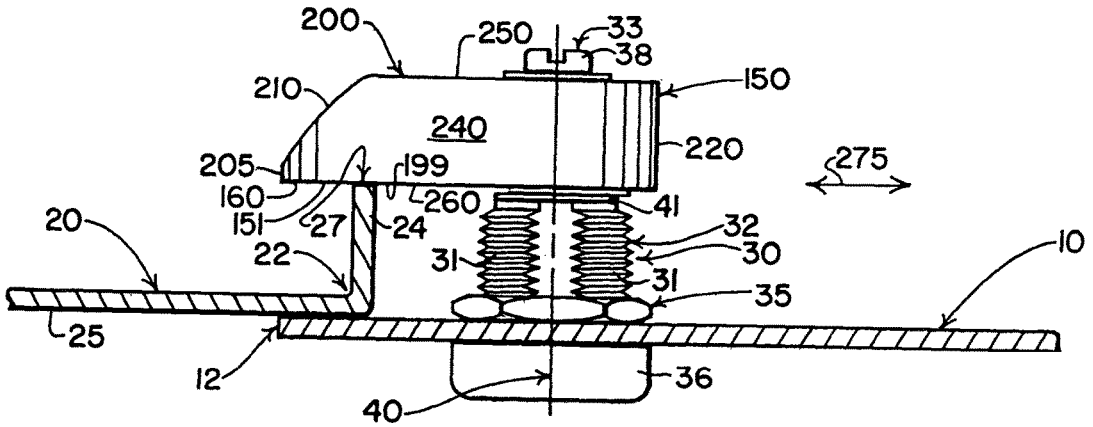
FIGS. 8-14 each show portions of the same door-type closure together with at least one of the adjacent cabinet portions that are shown in FIGS. 1, 3 and 5, with FIGS. 8-14 each also showing the same closure-mounted PRIOR ART cam lock operating mechanism that is shown in FIGS. 1-6, but with the elongate PRIOR ART cam (that is shown in FIGS. 1-6) having been removed and directly replaced with a spring-projected, retractable latch bolt assembly that embodies features of the present invention, wherein, more specifically.
Figure 10:
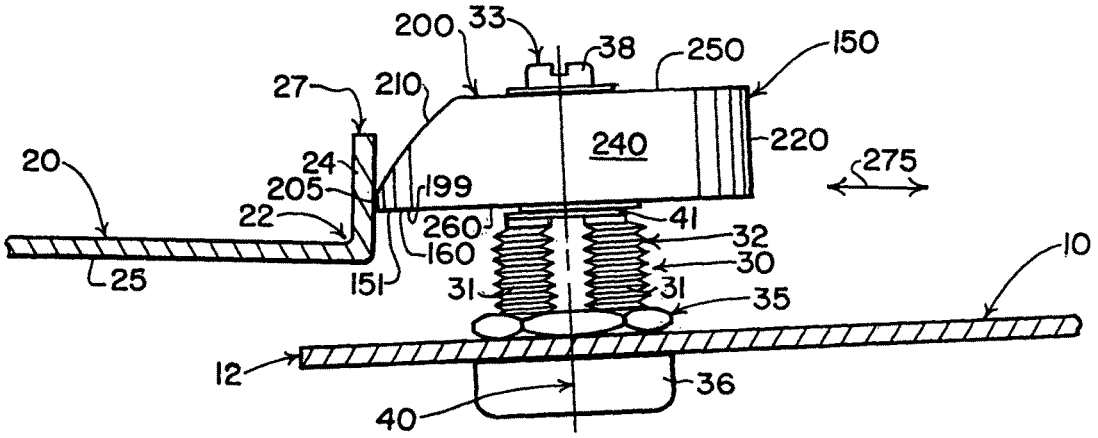
Figure 12:
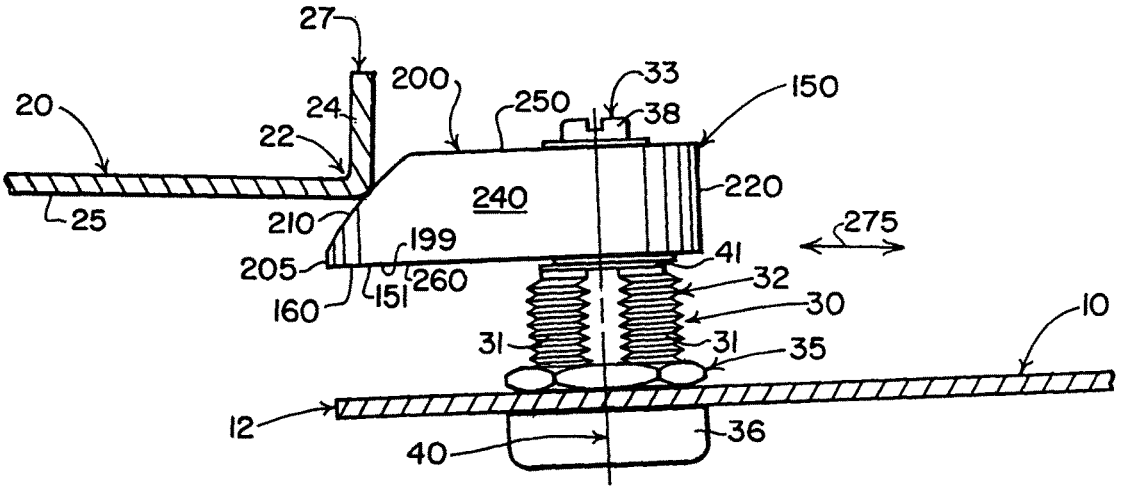

In FIGS. 8, 10 and 12—which show a spring-projected, retractable and extensible, latch bolt assembly 150 that embodies a preferred practice of the present invention, the assembly 150 has an "engagement surface 199" that does all the same work that the engagement surface 99 of the cam 50 did in locking and unlocking the door-type closure 10 in exactly the same way that the cam 50 locked and unlocked the closure 10. What all of the rest of the assembly 150 is provided for, is to increase, enhance or upgrade the cam lock operating mechanism of the cam lock 30 so the closure 10 can be moved to, or slammed to the closed and locked position (shown in FIG. 8) at a time when the assembly 150 is pivoted to the locked orientation shown in FIGS. 8, 10 and 12.

The reader will recall that, when working with the cam lock 30, the cam 50 had to be pivoted to the unlocked orientation shown in FIG. 6 if one wanted to close or open the closure 10. It was not possible to close the closure 10 with the cam 50 turned to the locked orientation shown in FIG. 3—because exactly the so-called IMPACT PROBLEM illustrated in FIG. 3 would occur if an attempt was made to move the closure 10 to its fully closed position while the can 50 was still turned to the locked orientation.

What FIGS. 10 and 12 illustrate, is how the latch assembly 150 can retract to permit the closure 10 to be moved to its fully closed position even when the latch assembly 150 is pivoted to its locked orientation as is shown in FIGS. 8, 10 and 12. The closure 10 is still movable to its closed position from an open position when the assembly 150 is pivoted to the unlocked orientation shown in FIG. 14—which is to say that, by substituting the assembly 150 for the cam 50, none of the functionality of the cam 50 is lost—rather, an ability to close the closure 10 when the assembly 150 is gained—hence the cam lock operating mechanism 33 is upgraded, or enhanced, or increased—depending on what term is most comfortable to be used.

To state the obvious one more time, replacing the cam 50 (which has a flat surface 99 that does all of the latching/locking work of the cam 50) with the retractable and extensible latch bolt assembly 150 does not, in any way, diminish the functionality that was provided by the cam 50. Replacing the cam 50 with the assembly 150 does not take away any of the functionality of the cam 50, but rather adds new functionality to the functionality provided by the cam 50—by permitting the closure 10 to fully close under circumstances that would have caused the cam 150 to create the IMPACT PROBLEM illustrated bu FIG. 3.

Accordingly, the reader will understand that this invention is almost entirely concerned with closing of the closure 10 in a new way that could not have been accomplished with use of the non-retractable cam 50.

Inasmuch as the example shown in FIGS. 8-14 makes use of the same door-type closure 10, the leftwardly extending cabinet component 20, and the cam lock components indicated generally by the numeral 30, with turnable components pivoting about the central axis 40, the closed and locked position of the door-type closure 10 that is shown in FIG. 8 is exactly the same as what is shown in FIG. 1, except that, in FIG. 8, the cam 50 has been removed from the cam lock operating mechanism 33, and has been replaced by the spring-projected, retractable latch bolt assembly 150.

One small difference is that the threaded fastener 38 (which is a short machine screw, as this component is shown in FIGS. 1, 3 and 5) is replaced by a longer machine screw that also is indicated by the numeral 38 in FIGS. 8, 10 and 12 inasmuch as the assembly 150 is thicker than is the elongate cam 50 that is replaced by the assembly 150.

In the description and the claims that follows, what is meant by the words "cam lock operating mechanism" is what is left of a conventional cam lock (such as the previously described cam lock 30, as well as in the patents referenced previously that disclose typical cam locks) at a time after a cam (such as the cam 50) is removed from a cam lock (such as the cam lock 30). Thus, because the cam lock 30 includes a "cam lock operating mechanism" to which is attached a cam 50, removing the cam 50 leaves what is meant by the expression "cam lock operating mechanism).

Figure 9:
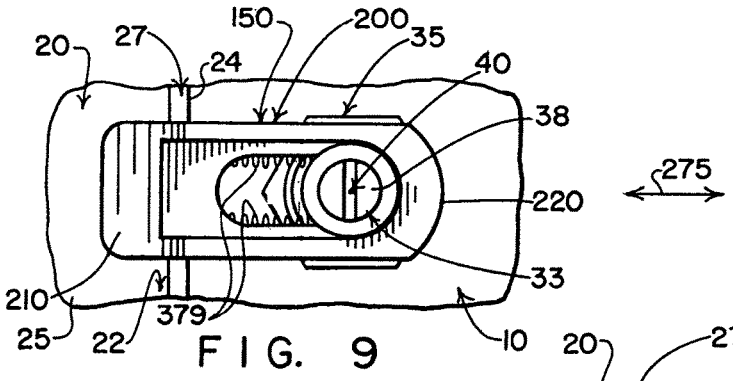
Figure 11:
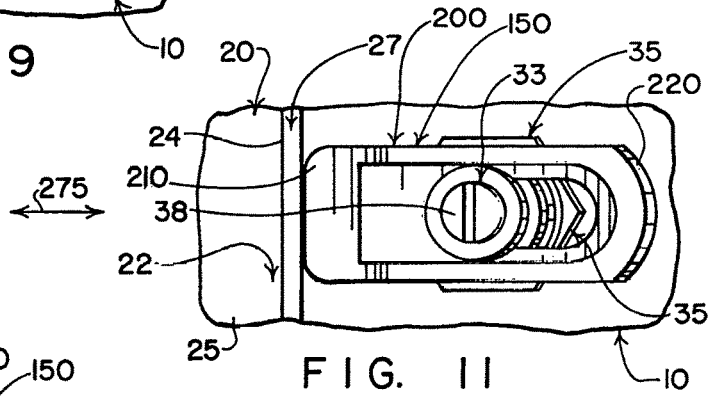
Figure 13:
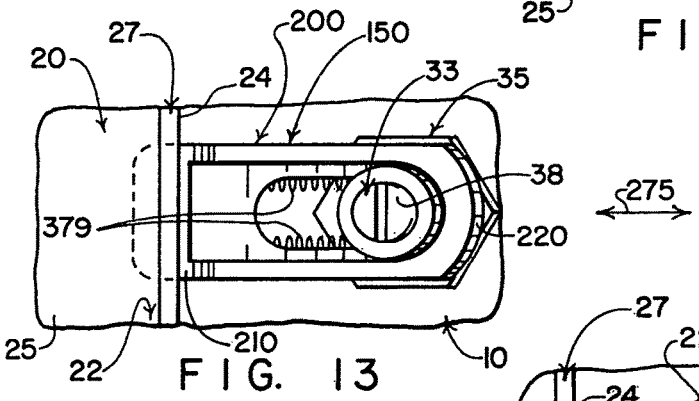

As is shown in FIG. 16, the spring-projected, retractable latch bolt assembly 150 is drivingly connected to the square, rearwardly extending formation 34 of the cam lock operating mechanism 33 (which formation 34 is shown in FIGS. 7 and 15-17) so the assembly 150 will be pivoted between locked and unlocked orientations just as the elongate cam 50 was pivoted between locked and unlocked orientations. The locked orientation of the assembly 150 is shown in FIGS. 8 and 9, and the unlocked orientation is shown in FIG. 14.

The best way to understand how the spring-projected retractable latch bolt assembly 150 can directly replace the traditional elongate cam 50 of the cam lock 30 is to compare what is shown in FIG. 8 with what is shown in FIG. 1.

FIG. 1 shows the door-type closure 10 in its closed position, with the operating mechanism 33 of the cam lock 30 having pivoted the elongate cam 50 to its locked orientation.

FIG. 8 shows the spring-projected retractable latch bolt assembly 150 of the present invention directly replacing the elongate cam 50, with the operating mechanism 33 of the cam lock 30 having pivoted the spring-projected retractable latch bolt assembly 150 to its locked orientation.

Also, for purposes of comparison, the unlocked orientation of the elongate cam 50 is shown in FIGS. 5 and 6; whereas the unlocked orientation of the assembly 150 is shown in FIG. 14.

The retractable latch bolt assembly 150 shown in FIG. 8 has a bottom surface 160 that is the so called "engagement surface 199 referred to previously (which also happens to be the bottom surface 260 of the manufactured component 200, as will be explained later herein) that corresponds to, and performs in much the same way as does the bottom surface 60 or engagement surface 99 of the cam 50—so that, when the latch bolt assembly 150 is turned to the locked orientation shown in FIG. 8, a distal end region 151 of the bottom surface 160,199 engages and overlies the end 27 of the short leg 24 to lock the door-type closure 10 in its closed position.

Major Components of the Retractable Latch Bolt Assembly

The spring-projected, retractable latch bolt assemblies 150 of the present invention are preferably formed from the four manufactured components 200, 300, 400, 500 that are shown in perspective in FIG. 19—however, a longer component 600 can be substituted for the shorter component 500—both of which are shown in perspective in FIG. 18.

FIG. 15 shows all five of the components 200, 300, 400, 500 and 600 in cross-section; FIG. 16 shows only the components 200, 300, 400, 600 in cross-section, and FIG. 17 shows only the component 600 in perspective.

The components 500, 600 can be held in place within the open front end region of the retractable latch bolt component 200 using the flat head screw 399 that is best shown in FIG. 15, and can additionally be held in place using an adhesive. The components 300, 400 are preferably held in place by the relatively long threaded fastener 38 that is best shown in FIG. 15.

Depending on the length of the tubular barrel 32 of a lock mechanism 30 that is to be installed, and depending on the thicknesses of the door-type closure 10 and the cabinet component 20 of a particular installation, either the short or the long spring-positioning components 500 or 600 may be chosen for use with the other manufactured components 200, 300, 400. The relatively long spring positioning component 600 may be needed when a lock having a relatively long tubular barrel 32 is to be used—as is shown in FIG. 16.

In FIG. 18, the components 200, 300, 400, 500 and 600 are shown in what will be considered to be a right side up orientation—whereas, in FIG. 19, the components 200, 300, 400 and 500 are considered to be in an upside down orientation. In the description that follows, any orientation-related words such as "vertical," "horizontal," "upstanding," "depending," "top," "bottom," "left," "right," "forward," "rearward" and the like will be understood to have little if anything to do with how these components or their parts, portions or regions are positioned during assembly and/or use of the variously depicted objects.

Referring variously to FIGS. 18 and 19, the largest, longest and most prominent of the depicted components is the elongate, retractable, latch bolt component 200. The latch bolt component 200 has several features, to which the attention of the reader is directed.

One of the prominent features of the component 200 to which the reader's attention is directed is the tapered, inclined or slanted front end surface indicated by the numeral 210. The other prominent and particularly important feature of the component 200 is its vastly open interior 215, which is best seen in FIG. 19 where the component 200 has an appearance something like an upside down bathtub that has a continuously-extending rim 260 that is defined by the bottom surface 260, and by lowermost portions of a short front wall portion 205, by lowermost portions of the opposite sidewalls 230, 240 and a semi-circular rear end wall 220.

The inclined front surface 210 is of particular importance because, when this inclined surface 210 is engaged by a stationary portion, region or component of a stationary cabinet or enclosure (portions of which are indicated by the numeral 20 in FIGS. 8-14 and 16) this engagement causes the spring-projected retractable latch bolt component 200 to retract in a manner depicted in FIGS. 10-13.

The importance of the latch bolt component's lengthy open interior 215 is also to be noted—for it not only permits the base component 300 to bring its top wall 310 up into supporting engagement with the bottom surface 271 of the latch bolt component 200, but also provides an open interior that extends for the majority of the length of the latch bolt component 200—which permits the base component 300 to reside underlie and support the bottom surface 271 of the transversely extending wall 270 when the latch bolt component 200 retracts as is shown in FIG. 10. Thus, the latch bolt component 200 is well supported regardless of whether it is in its normally extended position (as shown in FIGS. 8, 15 and 16, or whether it is retracted, as shown in FIG. 10).

Several other formations of the latch bolt component 200 merit mention. The upstanding sidewalls 230, 240 have interior, parallel-extending surfaces 231, 241, respectively. Moreover, the sidewalls 230, 240 are connected by an integrally formed, transversely extending wall that has a top surface 270 and a bottom surface 271. An elongate slot 290 is formed centrally through the transversely extending wall which has the top and bottom surfaces 270, 271, respectively; and this same wall which has the top and bottom surfaces 270, 271 is set down a short distance from the topmost surface 250, and is positioned upwardly from the bottom most surface 260 of the component 200.

Inside the downwardly-opening interior 215 of the latch bolt component 200 (and at a location behind the slanted surface 210 is a U-shaped formation that has a bottom wall 265, two short, spaced-apart legs 285 of the "U" and a central portion 287 that extends between the legs 285. When the short spring-positioning component 500 is installed inside the front end region of the open interior 215, the two spring-end-supporting troughs 579 support the end regions of the compression springs 379 that are not supported by the cylindrical projections 345. The fact that the two troughs 579 are not as long as a block of material 586 that extends between the two troughs 579 is best shown in FIG. 18. An upwardly facing surface 565 is provided by the short spring-positioning member 500 that engages the downwardly-facing bottom wall 265 of the latch bolt 200, and can be seen in the sectional views of FIGS. 15 and 16, and in the upside down view of the components 200, 300, 400, 500 provided by FIG. 16.

One additional feature of the component 200 is the countersunk hole 299 that is provided quite near to the inclined front surface 210. As can be seen in FIGS. 15 and 16, the countersunk hole 299 receives a flat headed screw 399 that has threads that hold well when tightened into holes formed in plastic for supporting one or the other of the spring-positioning members 500 or 600 inside a front end region of the open interior 215 of the component 200.

The complex configuration of the manufactured base component 300 can be seen variously in FIGS. 18 and 19 to have a top surface 310, a bottom surface 360, a semicircular rear end surface 320 and a relatively flat front surface 346. The base component 300 provides pair of spaced, generally cylindrical, parallel extending projections 345 that are sized to reach into end regions of a pair of compression coil springs 379. The springs 379 serve to bias the latch bolt component 200 away from the base component 300. Opposite end regions of the springs 379 are supported by the pair of trough formations 579 defined by the spring positioning component 500, or by trough formations 679 provided by the longer spring positioning component 600, as will be explained. (In FIGS. 15 and 16, the springs 379 appear to be pressing against rear walls 586, 686 of the spring-positioning components 500, 600, respectively, but this impression is incorrect, for the right end regions of the springs 379 actually continue on to be supported by the troughs 579, 679, and press against the wall 287 at the front end region of the open interior 215 of the latch bolt component 200.)

Although FIGS. 18 and 19, taken together, provide perspective views of the multi-stepped passage 390 that extends through the base component 300 in a coaxial manner relative to the central axis 40, the configuration of the passage 390 is best shown in FIG. 15 which shows the passage 390 with nothing extending into it. A relatively large diameter circular recess 325 is formed in an upper region of the component 300. A smaller diameter hole 335 extends downwardly from the large diameter circular recess 325 to where a short medium diameter 335 passage is formed—and, the medium diameter 336 is provided. Completing the passage 390 is a square recess 334 that receives the square end formation 34 of the operating mechanism 33, as shown in FIGS. 15 and 16. The small diameter hole 335 of the passage is sized to permit the threaded stem of the machine screw 38 to extend therethrough in a slip fit.

FIGS. 18 and 19 show the spindle component 400 to have a flat, annular top surface 460, a flat, annular bottom surface 470, and an annular, downwardly facing shoulder 485 that transitions from a relatively large, cylindrical upper region 480, to a relatively smaller cylindrical lower region 490.

The longer and larger spring positioning component 600 is configured exactly as is the smaller spring positioning component 500—except that the larger and longer component 600 has a rather large foot 601 on it, for use, as is shown in FIG. 16, to depend beneath the forward end region of the latch bolt component 200 to engage an upper surface of a stationary component that is indicated in FIG. 16 by the numeral 20. Longer and shorter spring positioning components (not shown) can also be provided if needed by a particular application.

The various features of the longer spring positioning component 600 do not require further explanation, for the reference numerals that indicate various features of the component 600 are the same numerals that have been used to designate features of the shorter component 500—except that the numerals used with the longer and larger component 600 have magnitudes that are increased by one hundred in comparison with the reference numerals used with the shorter componet 500.

When what has been referred to as the small spring positioning component 500 is pressed upwardly into the front end region of the large, downwardly opening region 215 of the latch bolt component 200, portions of the bottom wall 260 of the latch bolt component 200 that extend around the front end region of the latch bolt component 200 cooperate with a bottom surface 599 of the smaller component 500 to provide an engagement surface for being pressed against cabinet or enclosure formations—such as the rearwardly turned short leg 24 shown in FIGS. 1, 3, 5, 8, 10 and 12 that has an end surface 27.

Having described many of the features of the manufactured components 200, 300, 400, 500 and 600—and having described the machine screw 38, the flat headed screw 399, and the springs 375, what now needs to be explained is how these various components fit together in an advantageous manner.

Referring to the cross-sectional views provided by FIGS. 15 and 16, the base component 300 has a downwardly (forwardly) opening square recess 334 and an upwardly (rearwardly) opening cylindrical recess 325 that receive the square upwardly (rearwardly) extending formation at the upper (rear) of the operating mechanism 33, and the smaller diameter 490 of the spindle component 400. By this arrangement, and, by virtue of the threaded fastener 38 being tightened to press together the spindle component 400, the base component 300 and the upwardly (rearwardly) extending projection 34 of the operating mechanism 33, the components 300, 400 are securely drivingly connected to the operating mechanism 33 to pivot therewith about the central axis 40.

It is important that the retractable latch bolt assembly 150 be securely drivingly connected to the rearwardly extending mating formation 34 of the operating mechanism 33 of the cam lock 30—because, if the latch bolt assembly 150 is not securely drivingly connected to the rearwardly extending matable formation 34, the latch bolt assembly 150 will not be able to turn betweem the locked and unlocked orientations shown in FIGS. 5,6 and 14, respectively. Stated in another way, unless the components 300, 400 are securely connected to the matable formation 34, the latch bolt assembly 150 will not be able to perform the basic functions that were performed by the cam 50 to lock and unlock the cabinet or enclosure indicated by the numerals 20, 21 that refer to small portions of the cabinet or enclosure 20, 21.

As important as it is for the retractable latch bolt assembly 150 to be able to perform the locking and unlocking functions that were performed by the elongate cam 50 shown in FIGS. 1-6, without the operable driving connection of the latch bolt assembly 150 to the operating mechanism 33, even the enhanced, improved and upgraded functions of the present invention cannot be provided—for, if the retractable latch bolt mechanism 150 is turned to the unlocked orientation shown in FIG. 14 and cannot be turned to the locked orientation shown in FIGS. 8-13, none of the retraction of the latch bolt component 200 that is shown in FIGS. 10-13 can take place—and, indeed, the closure 10 cannot even be locked.

Consequently, the reader will understand that the present invention is intended to be used with locks that have a capability to pivot the retractable latch bolt assembly from the locked position shown in FIGS. 8 and 9 (so the locks can unlock a closure, and then can permit the closure to be moved to an open position while the latch bolt assembly 150 is in its unlocked orientation; AND, the present invention is intended for use with locks that have the capability to turn the latch bolt assembly 150 to the locked orientation shown in FIGS. 8 and 9 at a time when an associated closure on which a lock that carries the latch bolt assembly 150 is in an open position, so that benefit can be gained by having a retractable latch bolt 150 that can retract while in the locked orientation.

Having said all of the above about the base and spindle components 300, 400, respectively, these pressed-together components cooperate to perform yet another function—and this additional function is every bit as important as the other multi-functional responsibilities of the components 300, 400. As can best be seen in the assembly view of FIG. 16, the base component 300 has a top surface 310 that underlies, engages and supports the bottom surface 271 of the transversely extending wall 270 of the latch bolt component 200, AND the spindle component 400 has a shoulder 485 that overlies and engages the top surface 270 of the transversely extending wall of the latch bolt component 200—which is to say that the pressed-together base and spindle components 300, 400, respectively, sandwich the transversely extending wall 270 to keep the latch bolt component 200 moving properly along its travel path 275 as the latch bolt component 200 extends and retracts relative to the central axis 40.

Without this sandwiching of the top and bottom surfaces 270, 271 by the base and spindle components 300, 400, the retractable-extensible latch bolt component 200 could tilt and wobble up and down if an when a stationary component (such as the L-shaped cabinet or enclosure portion 20, or the wooden cabinet or enclosure portion 20 shown in FIG. 16 exerted up (rear) or down (forward) forces on the latch bolt component 200.

What has just been explained points to an equally important feature that is put to significant use by this invention. Not only do the base and spindle components 300, 400 provide surfaces 310, 485 that sandwich the transversely extending wall by engaging the top and bottom surfaces of the transversely exteding wall 270, the pairs of engaging surfaces 310, 271 and 485, 270 engage and cooperate to ensure that the latch bolt component 200 is confined to the desired travel path 275 as the latch bolt component 200 extends and retracts relative to the central axis 40.

Likewise, the inside surfaces 231, 241 of the latch bolt component 200 sandwich the sides 330, 340 of the base component 300—so, once again, pairs of engaging surfaces 231, 330 and 241, 340 are at work confining the latch bolt component 200 to its desired travel path 275.

Still further, the upper inside surfaces 232, 242 (FIG. 18) of the sidewalls 230, 240 sandwich the upper diameter region 480 of the spindle component 400—so, once again, pair of engaging surfaces 232, 480 and 242, 480 are at work confining the latch bolt component 200 to its desired travel path 275.

Clearly the spring-projected, retractable latch bolt component 200 (which does not have any bulky surrounding housing as do prior art proposals) is far better supported, and far better confined to its linear travel path 275 than are any of the prior art proposals for spring-projected, retractable, latch bolt assemblies which often use a loosely-fitting housing from which their latch bolts of minimal size project loosely outward from the ports of housings.

Providing spring-projected latch bolt components 200 that are closely confined to a specific linier travel path is not merely window dressing—for, relatively movable components that are properly supported by having a variety of surfaces in three-dimensional planes, as is explained above, results in far less wear and far longer service lives—for such components work with precision and do not dig into each other as they move relative to each other. Making such use of the vast open interior 215 of the latch bolt component 200 increases the service life and reliability of these described components of the latch bolt assemblies.

Referring still to FIGS. 15 and 16, when one or the other of the short or long spring-positioning components 500, 600, respectively, is installed to extend inside the forward end region of the downwardly (forwardly) opening interior 215, a broad surface (either 599 or 699) is provided by either the combination of the forward end region of the bottom surface 260 of the forward end region of the bottom surface 260 plus the bottom surface 599 of the spring positioning member 500, or by the large footprint of the large foot 601 of the spring positioning component 600.

During assembly of the components shown in FIG. 15, the springs 379 are each installed with one of their end regions installed over one of the cylindrical projections 345, and with their other end regions each supported by one of the troughs 579, 679—which means that the springs 379 press at one end against the front surface 346 of the base component 300, and press at their other ends against the surface 285 defined by the latch bolt component 200 which can only be seen in the upside down view provided by FIG. 19.

The example described above illustrates how a kit of componets that includes the manufactured components 200, 300, 400, 500, 600 together with the springs 379 and the fasteners 38 and 399 can be provided that permits existing cam locks 30 to be upgraded or enhanced simply by removing the cams 50 from their cam locks 30, and replace it with a kit of components such as are illustrated in FIGS. 18 and 19, together with the springs 379 and the fasteners 38 and 399, so that those who presently have cam locks in service will be able to enhance the longvity of their cam locks 30 and eliminate the IMPACT PROBLEM that is shown in FIG. 3.

As those who are skilled in the art will readily observe, the fastener 38 can be replaced by a larger diameter fastener (not shown) if a larger diameter fastener is required for a particular installation.

Although those skilled in the art will know the latest and best plastic materials to use, some have recommended that the manufactured components 200, 300, 400, 500 and 600 can be formed as by molding using such plastic materials as are often designated by the following codes or abbreviations Polyphenylene PE; Polycarbonate PC-GF15; Polypropylene PP; and Polyphenylene PE; POM-GF15, and PA66-PTFE. If molded from metal, zinc would, of course, be a candidate.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims whatever features of patentable novelty exist in the invention disclosed.

The invention claimed is:

1. An enhanced cam lock assembly, comprising:

a) a tubular housing supporting a cam lock operating mechanism capable of turning, about a rearwardly extending central axis to and between locked and unlocked orientations, a rearwardly extending formation suited to drivingly connect with and turn a cam about the central axis; and b) a spring-projected retractable latch bolt assembly suited to connect to and to be turned by the cam lock operating mechanism about the central axis in place of the cam, the latch bolt assembly comprising:

i) an elongate latch bolt component having first and second end regions that have the central axis located therebetween, with the first end region defining a slanted exterior surface that faces generally away from the central axis and away from the tubular housing for engaging a stationary component of an associated enclosure that movably supports a closure that carries the tubular housing, with the latch bolt component also having a pair of opposed, elongate sidewalls extending parallel to each other and integrally connecting the first and second end regions, with the elongate sidewalls and the end regions cooperating to define the perimeter of an elongate open interior of the elongate latch bolt component that opens toward the tubular housing;

ii) a base component configured to extend into the open interior of the latch bolt component and to provide opposed side surfaces that slidably engage interior surfaces of the opposed sidewalls, and defining a matable formation configured to drivingly engage the rearwardly extending formation in place of the cam, so that when the rearwardly extending formation is turned about the central axis to and between the locked and unlocked orientations, the base component and the latch bolt component turn concurrently therewith, with the latch bolt component being movable along a linear travel path relative to the base component that parallels the opposed sidewalls of the latch bolt component;

iii) a spindle component configured to cooperate with the base component in engaging the interior surfaces of the opposed sidewalls of the latch bolt component to confine the latch bolt component to a sliding movement along the linear travel path, which extends in a direction transverse to the central axis as determined by the turning of the rearwardly extending formation by the cam lock operating mechanism; and iv) a spring component interposed between the latch bolt component and the base component that biases the latch bolt component away from the central axis so the spring component will oppose any retraction of the latch bolt component toward the central axis such as may occur during closing movement of the closure on which the tubular housing is mounted when the linear travel path has been turned to the locked orientation, and when the slanted surface is pressed toward the central axis by being engaged by the stationary component of the associated enclosure during a closing movement of the closure on which the tubular housing is mounted—with the pressing of the slanted surface by the stationary component being relieved so the spring component can snap the latch bolt component to a position relative to the stationary component that locks the closure in a fully closed position promptly upon reaching the fully closed position.

2. The enhanced cam lock assembly of claim 1 wherein the operating mechanism defines a forwardly opening keyway into which a correctly configured operating key can be inserted, and that enables the inserted key to be turned about the central axis to cause the rearwardly extending formation to be turned correspondingly about the central axis between the locked and unlocked orientations.

3. The enhanced cam lock assembly of claim 1 wherein the rearwardly extending formation comprises a generally rectangular projection for being received in a matable formation of the base component which defines a substantially rectangular recess configured to snugly receive the generally rectangular projection to establish a driving connection between the rearwardly extending formation and the matable formation.

4. The enhanced cam lock assembly of claim 1 wherein the latch bolt component includes a transversely extending wall that overlies the open interior of the latch bolt component and has an elongate slot formed therethrough that has parallel-extending sides that substantially parallel the linear travel path of relative movement of the latch bolt component and the base component, with the spindle component having a portion extending through the elongate slot, that drivingly connects to the base component so the base component and the spindle component move together along the linear travel path when relative movement takes place between the latch bolt component and the base component, and that slidably engages the parallel-extending sides of the elongate slot to assist the base component in confining relative movement of the base component and the latch bolt component to the linear travel path.

5. The enhanced cam lock assembly of claim 4 wherein:

a) the transversely extending wall is of substantially uniform thickness at least in regions located near the slot and extending along one and the other sides of the elongate slot for at least a majority of the length of the slot;

b) the base component has surface portions that slidably engage said regions extending along one side of the transversely extending wall; and c) the spindle component has surface portions that slidably engage said regions extending along the other side of the transversely extending wall.

6. The enhanced cam lock assembly of claim 1 wherein the rearwardly extending formation carries a threaded opening that extends along the central axis, and the enhanced cam lock assembly further comprises a threaded fastener that extends through aligned passages formed through the spindle and base components, and into the threaded opening to enhance security of the driving connection of the spindle and base components to the rearwardly extending formation.

7. The enhanced cam lock assembly of claim 1 additionally including a spring positioning component that engages an end region of the spring component to support the spring component inside the open interior of the latch bolt component.

8. The enhanced cam lock assembly of claim 1 wherein the base component includes a generally cylindrical projection sized and configured to extend inside an end region of the spring component.

9. The enhanced cam lock assembly of claim 8 wherein the spring component includes two compression coil springs interposed between the latch bolt component and the base component that biases the latch bolt component away from the central axis, and the base component includes two spaced formations, each of which formations extend inside an end region of a different one of the compression coil springs.

10. The enhanced cam lock assembly of claim 9 additionally including a spring positioning component that defines two spaced trough formations that support and position opposite end regions of the two compression coil springs to engage wall formations of the latch bolt component.

11. The enhanced cam lock assembly of claim 1 wherein the latch bolt component defines an engagement surface that faces toward the tubular housing and is configured to engage the stationary component in a manner that is consistent with how the cam would function to retain the closure in the fully closed position when turned by the rearwardly extending formation to the locked orientation.

12. A slam capable spring-projected latch assembly drivingly connectible to a matable drive formation of a housing-supported lock operating mechanism that extends rearwardly along a central axis about which the operating mechanism can pivot the slam-capable latch assembly to and between angularly spaced locked and unlocked orientations, comprising:

a) an elongate latch bolt component having first and second end regions spaced in opposite directions from the central axis, with the first end region defining a slanted exterior surface facing away from the central axis, with a pair of opposed elongate sidewalls having elongate interior surfaces located on opposite sides of the central axis that extend between and integrally connect with interior formations of the first and second end regions, and cooperating with the interior formations to define a perimeter of an elongate open interior of the elongate latch bolt component;

b) a base component configured to drivingly connect the base component to the rearwardly facing matable formation of the operating mechanism to thereby ensure that the base component pivots about the central axis concurrently with the rearwardly facing matable formation, with the base component having opposed side surfaces located on opposite sides of the central axis when the base component is drivingly connected to the rearwardly facing matable formation, and with the opposed side surfaces slidably engaging the elongate interior surfaces of the elongate latch bolt component;

c) a spindle component configured to cooperate with the base component in engaging the elongate interior surfaces to confine relative movement of the base and latch bolt components to a sliding movement along a linear travel path that extends in a direction that is transverse to the central axis, wherein:

i) the base component cooperates with the rearwardly extending formation to turn the direction of the linear travel path about the central axis to and between a locked orientation and an unlocked orientation;

ii) the latch bolt component is biased to project the slanted face along the linear travel path away from the central axis and into engagement with a stationary component of an associated enclosure; and iii) the base component cooperates with the interior formation of the second end region to limit movement of the latch bolt component along the linear travel path away from the central axis.

13. A kit of components assemblable to form a spring-projected, retractable and extensible latch bolt assembly that can be attached to a rearwardly facing formation of a cam lock operating mechanism in place of a usual cam that defines a forwardly-facing engagement surface that can, when attached to the rearwardly facing formation selectively extend behind, and can withdraw from extending behind, a stationary component of an associated enclosure to lock and unlock a closure that is supported by the associated enclosure for movement to and between closed and open positions, and that, while in the closed position, can be selectively locked and unlocked by turning the rearwardly facing formation to and between locked and an unlocked orientations, with the kit comprising:

a) an elongate latch bolt component having first and second end regions that have a central axis located therebetween, with the first end region defining a slanted exterior surface that faces generally away from the central axis and away from a tubular housing for engaging a stationary component of an associated enclosure that movably supports a closure that carries the tubular housing, with the latch bolt component also having a pair of opposed, elongate sidewalls extending parallel to each other and integrally connecting the first and second end regions, with the elongate sidewalls and the end regions cooperating to define an engagement surface facing toward the tubular housing, and defining the perimeter of an elongate open interior of the elongate latch bolt component that opens toward the tubular housing;

b) a base component configured to extend into the open interior of the latch bolt component and to provide opposed side surfaces that slidably engage interior surfaces of the opposed sidewalls, and defining a matable formation configured to drivingly engage the rearwardly facing formation in place of a cam, so that when the rearwardly facing formation is turned about the central axis to and between the locked and unlocked orientations, the base component and the latch bolt component turn concurrently therewith, with the latch bolt component being movable along a linear travel path relative to the base component that parallels the opposed side walls of the latch bolt component;

c) a spindle component configured to cooperate with the base component in engaging interior surface portions of the opposed sidewalls of the latch bolt component to confine the latch bolt component to a sliding movement along the linear travel path extending in a direction transverse to the central axis as determined by the walls of the rearwardly facing formation by the cam lock operating mechanism; and, d) a spring component interposed between the latch bolt component and the base component that biases the latch bolt component away from the central axis so the spring component will oppose any retraction of the latch bolt component toward the central axis such as may occur during closing movement of a closure on which the tubular housing is mounted when the linear travel path has been turned to the locked orientation, and when the slanted surface is pressed toward the central axis by being engaged by the stationary component of the associated enclosure during a closing movement of the closure on which the tubular housing is mounted—with the pressing of the slanted surface by the stationary component being relieved when the closure reaches the fully closed position so the spring component can snap the latch bolt component to a position in relation to the stationary component that locks the closure in a fully closed position promptly upon the closure reaching the fully closed position.

14. The kit of components of claim 13 wherein the latch bolt component includes a transversely extending wall that overlies the open interior of the latch bolt component and has an elongate slot formed therethrough that has parallel-extending sides that substantially parallel the linear travel path of relative movement of the latch bolt component and the base component, with the spindle component having a portion extending through the elongate slot, that drivingly connects to the base component so the base component and the spindle component move together along the linear travel path when relative movement takes place between the latch bolt component and the base component, and that slidably engages the parallel-extending sides of the elongate slot to assist the base component in confining relative movement of the base component and the latch bolt component to the linear travel path.

15. The kit of components of claim 14 wherein:

a) the transversely extending wall is of substantially uniform thickness at least in regions located near the slot and extending along one and the other sides of the elongate slot for at least a majority of the length of the slot;

b) the base component has surface portions that slidably engage said regions extending along one side of the transversely extending wall; and, c) the spindle component has surface portions that slidably engage said regions extending along the other side of the transversely extending wall.

16. The kit of components of claim 13 wherein the rearwardly extending formation carries a threaded opening that extends along the central axis, and the cam lock operating mechanism further comprises a threaded fastener that extends through aligned passages formed through the spindle and base components, and into the threaded opening to enhance security of the driving connection of the spindle and base components to the rearwardly extending formation.

17. The kit of components of claim 13 additionally including a spring positioning component that engages an end region of the spring component to support the spring component inside the open interior of the latch bolt component.

18. The kit of components of claim 13 wherein the base component includes a generally cylindrical projection sized and configured to extend inside an end region of the spring component.

19. The kit of components of claim 13 wherein the latch bolt component defines an engagement surface that faces toward the tubular housing and is configured to engage the stationary component in a manner that is consistent with how the cam would function to retain the closure in the fully closed position when turned to the locked orientation.

20. A kit of components attachable as a slam-capable, spring-projected, retractable and extensible latch bolt assembly to a rearwardly facing matable formation of an operating mechanism of a cam lock instead of an elongate cam, with the components comprising:

a) an elongate latch bolt component having first and second end regions spaced in opposite directions from a central axis, with the first end region defining a slanted exterior surface facing away from the central axis, with a pair of opposed elongate sidewalls having elongate interior surfaces located on opposite sides of the central axis that extend between and integrally connect with interior formations of the first and second end regions, and cooperating with the interior formations to define a perimeter of an elongate open interior of the elongate latch bolt component;

b) a base component configured to drivingly connect to the rearwardly facing matable formation of the operating mechanism to thereby ensure that the base component pivots about the central axis concurrently with the rearwardly facing matable formation, with the base component having opposed side surfaces located on opposite sides of the central axis when the base component is drivingly connected to the rearwardly facing matable formation, and with the opposed side surfaces slidably engaging the elongate interior surfaces of the elongate latch bolt component;

c) a spindle component configured to cooperate with the base component in engaging the elongate interior surfaces to confine relative movement of the base and latch bolt components to a sliding movement along a linear travel path that extends in a direction that is transverse to the central axis, wherein:

i) the base component cooperates with the rearwardly facing matable formation to turn the direction of the linear travel path about the central axis to and between a locked orientation and an unlocked orientation;

ii) the latch bolt component is biased to project the slanted exterior surface along the linear travel path away from the central axis and into engagement with a stationary component of an associated enclosure; and iii) the base component cooperates with the interior formation of the second end region to limit movement of the latch bolt component along the linear travel path away from the central axis.

* * * * *